United States Patent [19]

Gregoli

[11] 3,972,801

[45] Aug. 3, 1976

[54] OIL SHALE RETORTING

[75] Inventor: Armand A. Gregoli, Tulsa, Okla.

[73] Assignee: Cities Service Research & Development Co., Tulsa, Okla.

[22] Filed: Oct. 29, 1974

[21] Appl. No.: 518,443

[52] U.S. Cl. ..... 208/11 R; 201/12

[51] Int. Cl.[2] ..... C10G 1/02

[58] Field of Search ..... 208/11; 48/197 R; 201/12

[56] References Cited

UNITED STATES PATENTS

| | | | |
|---|---|---|---|
| 2,449,615 | 9/1948 | Peck | 208/11 R |
| 2,474,345 | 6/1949 | Clark et al. | 48/197 R |
| 2,550,432 | 4/1951 | Thompson | 208/11 |
| 2,814,587 | 11/1957 | Van Dijck | 208/11 |
| 3,384,569 | 5/1968 | Peet | 208/11 |
| 3,475,319 | 10/1969 | MacLaren | 208/11 |
| 3,597,347 | 8/1971 | Ellington | 208/11 |
| 3,617,468 | 11/1971 | Reyburn et al. | 208/11 |
| 3,784,462 | 1/1974 | Frick | 208/11 |

*Primary Examiner*—Delbert E. Gantz
*Assistant Examiner*—James W. Hellwege
*Attorney, Agent, or Firm*—George L. Rushton

[57] ABSTRACT

Oil shale is retorted in a vertical reactor that is separated into discrete zones. Sensible heat from hot spent shale is used for the thermal decomposition of kerogen, which is done in the absence of air, thus liberating a maximum of desirable products, without loss of product by combustion, and avoiding the necessity of separating and removing gaseous combustion products from the volatilized kerogen. The carbonaceous residue on the retorted shale is combusted to furnish the sensible heat used in the various parts of the process.

3 Claims, 2 Drawing Figures

OIL SHALE RETORTING

BACKGROUND OF THE INVENTION

This invention relates to the retorting of oil shale under conditions to recover shale oil. More particularly, this invention relates to the retorting of oil shale under conditions such that the reaction products are not contaminated with products of combustion. Further, the retorting takes place under conditions such that energy is conserved and no outside fuel source is required.

The location of oil shale deposits is well known, and the processing of these deposits to recover valuable products is becoming more important in modern technology. The solid organic portion of oil shale is known as kerogen. When the shale is heated to an elevated temperature, the kerogen is decomposed by pyrolysis to give shale oil, light hydrocarbon gases and a carbonaceous residue. The technology of shale oil is well covered in Vol. 18 of "Kirk-Othmer Encyclopedia of Chemical Technology" (Interscience-John Wiley-New York).

A typical system for processing oil shale concerns a vertical retort having several sections, such as (a) a pre-heating section in which fresh shale is heated to retort temperature by any of several means, such as intermixing with hot spent shale or by direct heat transfer with hot combustion gases, (b) a retorting section in which the kerogen is pyrolyzed to give various products, (c) a combustion section in which combustible material, such as carbonaceous residue on the shale or the light hydrocarbon gases from the pyrolysis of the shale, are burned to furnish heat for the system, and (d) a spent shale section wherein some of the sensible heat is recovered from the hot spent shale.

Two of the major problems in this process concern the material handling of large amounts of shale and the exchange of heat between hot spent shale and fresh shale to give the necessary pyrolysis temperature. The prior art literature offers many proposed solutions for these problems, as discussed in the Kirk-Othmer article. However, these prior art methods typically have two disadvantages: (a) some of the kerogen material is used as fuel to provide heat for the pyrolysis, thus diminishing the yield of product per ton of shale, and (b) when the carbonaceous residue on the spent shale is burned to furnish heat for the process, the gaseous products of combustion and of carbonate decomposition are mixed with the pyrolysis products to give a low heating value (BTU/SCF) (kg. cal./m$^3$) product.

These disadvantages are overcome in my process for the retorting of hydrocarbons from oil shale granules in a retorting vessel in which the oil shale is subjected to thermal decomposition of kerogen contained therein by the addition of heat, in the substantial absence of oxygen, and from which distillation reaction products are obtained substantially free of gaseous products of combustion and of carbonate decomposition, during the downward passage of shale through a plurality of physically separated zones in the vessel, the process comprising the steps of:

a. mixing fresh oil shale and hot spent shale in a hopper zone,
b. removing gases from the shale mixture in a first low pressure zone,
c. subjecting the shale mixture to an inert purge stream in a first purge zone, d. forming reaction products by thermal decomposition of kerogen in a reaction zone and removing and recovering said products, incidentally forming a carbonaceous residue on the shale,
e. subjecting the retorted shale mixture to an inert purge stream in a second purge zone,
f. removing gases from the retorted shale mixture in a second low pressure zone, and
g. heating the retorted shale mixture by combustion of its carbonaceous residue.

My invention also includes the apparatus containing the above-mentioned zones in the retorting vessel.

As a result of my invention, several advantages are noted:

a. heat values are recovered from the hot spent shale,
b. shale fines can be used in the process,
c. the reaction products (from the reaction section) are undiluted by gaseous products of combustion and have an improved heating (BTU/SCF) (hg.cal./m$^3$) value,
d. the product from the reaction section is produced in more than 100% yield based on the Fischer assay,
e. the fuel requirement per barrel of product is significantly negligible,
f. the temperature of the reaction section is controlled so as to minimize carbonate decomposition in the shale,
g. steam, used in the purge sections, is an essentially inert vapor and is easily condensible and removable from the other products,
h. the net product yield per ton of shale is significantly higher than prior art processes, and
i. the shale requirements per barrel of product are lower than prior art processes.

These advantages are obtained by maintaining spent shale temperatures below 1400°F. to prevent agglomeration of particles and to minimize use of expensive materials of construction.

The above-described process and the advantages of the invention are more fully understood by referring to the drawings.

DETAILED DESCRIPTION OF THE INVENTION

Figures 1, 2:
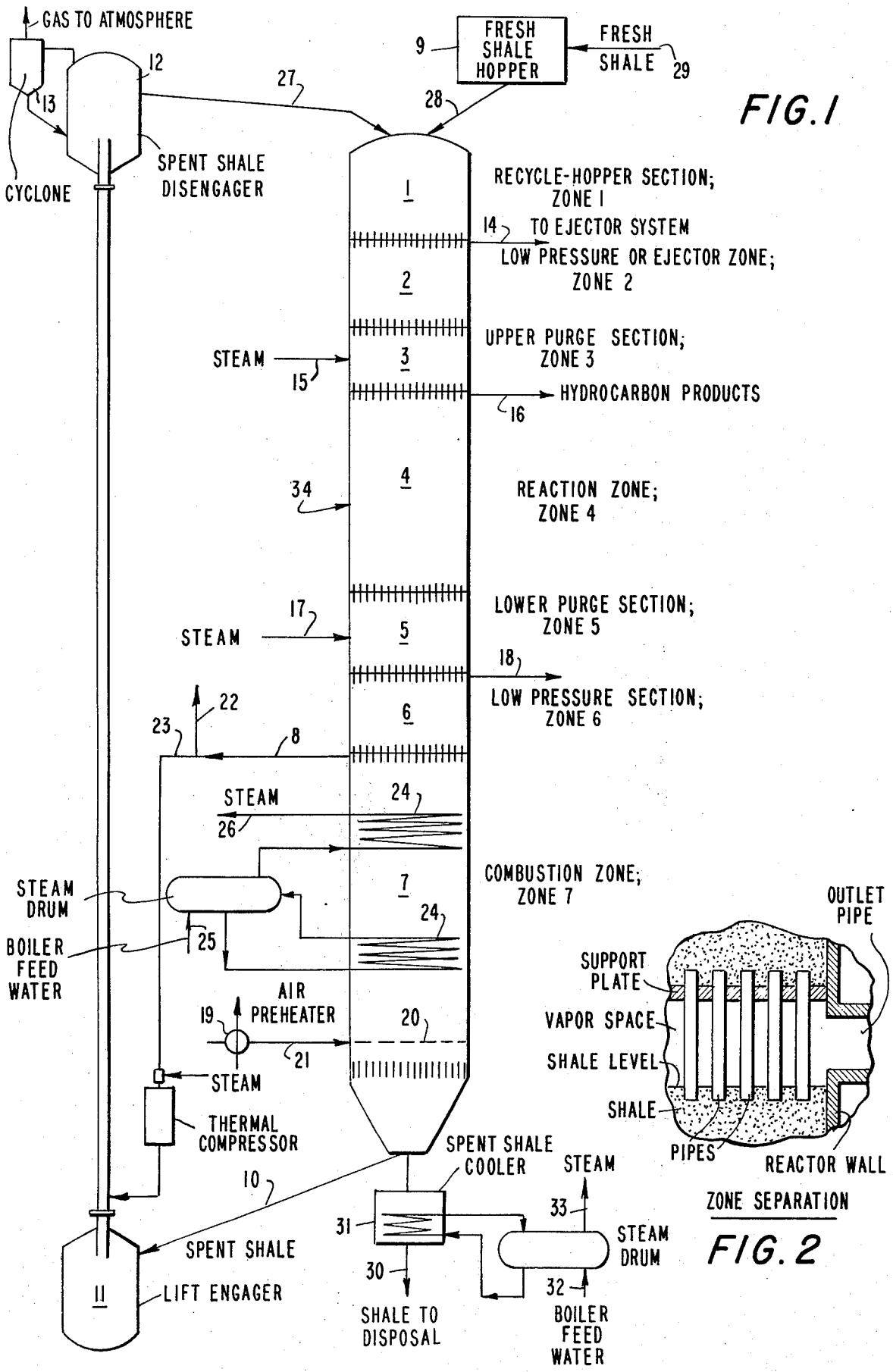
FIG. 1 shows a vertical section of the retorting vessel.
FIG. 2 shows one embodiment of the method of zone separation.

Crushed oil shale is treated in a vertical retorting vessel, with fresh shale being mixed with hot recycle shale and the mixture being fed into the top of the vessel at a rate commensurate with the removal of hot spent shale from the bottom of the vessel. From top to bottom, the vessel is separated into distinct sections or zones, each having its own function and operating conditions. Broadly, these zones can be labeled top, intermediate and bottom zones, with fresh shale entering the top zone and spent shale exiting the bottom zone and with various phases of the process occurring in the intermediate zones. These zones, while contiguous, are physically separated, one from the other, by horizontally inclined plates containing a plurality of vertically inclined pipes or tubes that allow the crushed or granular shale to move by gravity downwardly through the various zones. At the same time, the intermediate zones are equipped with horizontally inclined inlet and outlet conduits for the introduction and removal of various fluids. The pressures in these various zones can be super- or sub-atmospheric, as well as atmospheric, depending on the function of that particular zone.

One embodiment of the invention is described in general fashion by referring to FIG. 1. Crushed shale is delivered to fresh shale hopper 9, with the fresh feed going either to zone 1 or zone 3 of the vertical retorting vessel 34. Hot spent shale, typically recovered from the bottom of the retorting vessel 34, is also fed from spent shale disengager 12, to zone 1, called recycle hopper section. Here the hot spent shale, or recycle shale, can be mixed with fresh feed shale, cooling the hot spent shale and warming the fresh feed shale. It is emphasized that the residence time or time of contact between the hot and feed shales is short enough so that thermal decomposition of the feed shale is minimized and yet long enough to give some preheating of the feed shale. The mixture travels downward to zone 2, the first low pressure zone, from which various gases, entrained dust and steam are removed through line 14. The mixture next enters zone 3, the upper purge section, wherein stripping steam, entering by line 15, is passed through the mixture of shale. In an alternate embodiment, fresh shale is introduced in zone 3 and mixed with the hot spent shale received from zone 2. It is recognized that any air, free or absorbed, entering with the fresh shale, will be substantially removed through zone 2. The steam flow exits from zone 3 partly through zone 2, removing a majority of air and trapped (or absorbed) gases from the shale mixture, and partly through zone 4, wherein the steam and reaction products are removed through line 16. The operating pressure in zone 3 is higher than the pressure in zone 2 or zone 4.

Zone 4, the reaction section, is where the majority of reactions occur (i.e., the thermal decomposition of the kerogen) that liberate the hydrocarbonaceous products from the feed shale and result in the formation of a carbonaceous residue on and in the shale particles. The volatilized gaseous products are separated and removed from the reaction section through line 16.

The shale mixture, now substantially deleted of desirable hydrocarbonaceous products, enters zone 5, the lower purge section. In this purge section, as in the upper purge section, steam is introduced through line 17 in order to segregate the desirable reaction products in zone 4 from any undesirable gaseous products in zone 6, which is the lower ejection zone, in the same manner in which zone 3 segregates zone 2 from zone 4. After undesirable gases are ejected from the shale mixture in zone 6 through line 18, the shale enters zone 7, the combustion zone wherein any residual carbonaceous material on the shale reacts with air introduced into the zone through line 21, resulting in an exothermic reaction which raises the temperature of the shale mixture and produces various products of combustion, including inert nitrogen, oxides of carbon and unreacted oxygen. Although not shown in the drawing, the combustion zone can be further physically separated in sub-zones, with air introduced to one or more sub-zones for controlled combustion. This zone furnishes the heat energy required in zone 4 to separate the desirable oil shale products from the shale feed. The temperature of the exiting spent shale is controlled by regulating the air rate, i.e., oxygen rate, entering zone 7. Other controlling factors useful in maintaining the desired spent shale temperature include utilization of heat exchange coils 24 in one or more sub-zones and/or varying the spent shale residence time by changing the flow or movement rate of the descending solids. As seen from the drawing, steam is made by introducing boiler feed water into exchanger coils located in zone 7. The hot spent shale exits zone 7, for further disposition. Those skilled in the art will recognize that the spent shale cooler 31, located below zone 7, is a heat exchanger embodiment by which at least some of the residual heat is recovered from the spent shale. It is also recognized that the gaseous combustion products from zone 7 can be utilized to preheat the fresh shale and incoming air, such as in air preheater 19 and that further heat can be obtained from the waste gas stream by more complete combustion of, for example, the carbon monoxide component of the stream.

I prefer to call my process a "Non-Combustion" retorting process, since no outside fuel is used as a source of heat, essentially none of the desirable reaction products from the thermal decomposition of the shale is combusted to form heat, and no gaseous products of combustion are mixed with the desirable reaction products obtained in the reaction zone. It is well known in the art that typical retorting of the shale results in a deposit of coke-like material on the retorted shale. The controlled combustion of this carbonaceous material can and does furnish the heat necessary for the decomposition of kerogen. Thus, heat is transferred from the combustion zone 7 to the reaction zone 4, without being accompanied by combustion gases. This step simplifies the ultimate purification of the reaction products from the reaction zone. Another facet of this process is the low energy requirement relative to prior art versus combustion processes. The theoretical energy required to raise the shale to a retorting temperature of 900°F (482°C.) from ambient is about 640,000 BTU/ton (178 g.cal./g.). At retorting temperatures above about 1100°F. (593° C.), mineral carbonates begin to decompose. This decomposition not only absorbs a large amount of heat, approximately 1300 BTU/lb (723 g.cal./g.) of $CO_2$ liberated, but also dilutes the retort gas. The mineral $CO_2$ content of oil shale ranges from 300 to 400 lbs/ton (150–200 g/kg), and thus additional energy requirements due to carbonate decomposition range from 400,000 to 500,000 BTU/ton (111–139 g.cal./g). Since the temperature of my process is well below the carbonate decomposition temperature, $CO_2$ will range from 0 to 20 lbs/ton (0–10 g/kg.) shale. This is well below the amount expected for other combustion type processes wherein $CO_2$ is 200 to 400 lbs/ton (100–200 g./kg.) shale. Furthermore, no $CO_2$ from combustion dilutes the retort products in my process, which is in contrast to combustion type processes. Thus, the non-combustion process requires the separation and disposal of much less $CO_2$ than does the combustion process or other shale processes.

The above disclosure presents a general description of the overall process, while more detailed parameters are described below.

As used in my process, the shale is crushed to pieces about ¼ inch (0.63 cm.). Thus, the overall particle range used in this process is that obtained by typical crushing to obtain about ¼ inch (0.63 cm.) feed materials, without rejection of a fines cut. It will be appreciated by one skilled in the art that an excessive amount of fines will cause distribution problems in a retorting vessel and will also result in an excessive pressure drop. At the same time, additional energy is required to crush the larger particles to the fine size. Thus, while my process can accommodate fines, it is generally desirable that the percentage of fines in the fresh feed by minimized. The crushed shale is moved to the fresh shale hopper by any of several convenient and well-known methods, such as by pneumatic or mechanical lifting. FIG. 1 illustrates the use of a gas lift leg, in which hot spent shale exits the base of retort 34, is carried to a spent shale lift engager 11 through line 10, is lifted to disengager 12 by gas from line 23, and then moves from disengager 12 by gravity through line 27 to enter zone 1. The lift gas is separated from fines and dust in cyclone 13, reducing air pollution.

As noted previously, the fresh shale feed can be delivered to either zone 1 or zone 3. At the same time, the fresh shale feed can be pre-heated by vent gases 8, the combustion products from zone 7, as a heat recovery device. It is recognized that, depending upon the amount of preheating, the temperature of the fresh shale feed will vary between ambient and 200°–300°F. (93°–149°C.). While the fresh shale feed is entering the retorting vessel, spent shale, meaning shale substantially free of kerogen and carbonaceous residue, is taken from the bottom of the retorting vessel through line 10 and, by well-known means, such as a lift engager, recycled to the hopper section, zone 1. Depending on the combustion temperatures, the amount of steam formed, and other heat losses, the spent shale leaving the bottom of the retorting vessel can have a temperature of from approximately 1100° to about 1400°F. (593°–760°C.).

This spent shale is lifted by a lift engager 11 to a spent shale disengager 12, from whence it enters the recycle hopper section 1. The pressure in this section is approximately atmospheric, while the average temperature, depending on the previously mentioned factors, can vary from about 800°–950°F. (426°–510°C.), but it is understood that the colder fresh shale particles do not reach this average temperature immediately. Some of the gases used in the lift system are vented via cyclone 13, and the solids are returned to the spent shale disengager to avoid air pollution. The shale moves, by gravity, to the next zone by way of vertically aligned pipes or tubes which are arranged in a horizontally oriented plate that physically isolates the various zones, as shown in FIG. 1. FIG. 2 shows one arrangement of this separating device. The number, spacing and dimensions of these pipes, tubes or conduits are generally not critical, as long as sufficient structural strength is retained in the horizontal plate to resist buckling by the load above, to afford sufficient passage of the shale to provide the desired throughput of the retorting vessel, and to form a sufficient bed to provide proper distribution of moving solids and allow passage of gases, vapors, etc. Typically, in a retorting vessel having a 10 foot (3.05 m.) diameter, there will be approximately 400 pipes, approximately 3 inches I.D. (7.6 cm.) and about 2 to 4 feet (0.61–1.2m.) in length, spaced throughout the horizontal plate so as to provide proper downflow and to avoid any channeling. Alternatively, the number of pipes can be substantially less, with each pipe having a larger diameter.

In zone 2, the first low pressure zone, air, other gases absorbed on or in the shale, and steam formed by volatilized water, are removed from the shale by pipe 14. The pressure in zone 2 is lower than the pressures in adjoining zones 1 and 3, with this lower pressure (approximately 2–10 inches of water below atmospheric) (50.8 – 254 kg./m$^2$ below atmospheric) being achieved, for example, by an ejector system, not shown.

The hot deaerated shale then passes into zone 3, the upper purge zone, in which steam is introduced, via line 15 and a suitable distributor, to act as a purging medium to assist in the physical separation of the gaseous material in zone 2 from the desirable reaction products of zone 4. The pressure in zone 3, due to the steam, is kept at super-atmospheric pressure, such as about 10 to 50 inches of water (254–1270 kg./m$^2$) above atmospheric, pressure a pressure in excess of the pressures found in zone 2 and zone 4. The temperatures found in zones 2 and 3 are not critical but, due to heat losses, will be approximately the same as or slightly below the temperature found in zone 1, especially if some or all fresh shale is added to zone 3, as alternative to the shale addition to zone 1.

In zone 4, the reaction zone, the desirable reaction products resulting from the thermal decomposition of kerogen are separated from the shale and removed from the reaction zone via line 16, typically leaving a carbonaceous residue on the retorted shale. The temperature of zone 4 typically varies from about 800° to 950°F. (426°–510°C) while the pressure is slightly more than atmospheric (about 5–40 inches of water) (127–1016 kg/m$^2$), sufficient to maintain a flow of the reaction products. The presence of steam in zone 4 is non-deleterious since it is a minor amount of the volatile fluids present and is readily condensable, in contrast to the hydrocarbonaceous products obtained from the shale. Thus, downstream treatment of the effluent from zone 4 in line 16 can be handled by typical equipment used by those skilled in the art. The atmosphere in zone 4 is substantially free of air or oxygen.

The retorted shale mixture, essentially free of desirable reaction products and typically containing carbonaceous residue, moves to the lower purge zone 5 wherein the temperature is in the range of about 800°–950°F. (426°–510°C.) and the pressure, due to purge steam 17 introduced in zone 5 through a suitable distributor is about 10 to 50 inches of water above atmosphereic pressure (254–1270 kg./m$^2$). Here again, due to the zone pressure that is higher than that found in adjacent zones, this purge zone acts to isolate the reaction zone from the second low pressure zone, thus assuring a barrier to the flow of combustion gases from the combustion zone 7. At the same time, steam flowing from the lower purge section 5 to the reaction section 4, by its sweeping action assures the removal of reaction products from the reaction zone.

The mixture next enters zone 6, the second low pressure zone, in which, due to the ejection system used, the pressure is below atmospheric (about 2–10 inches of water below atmospheric) (50.8–254 kg/m$^2$ below atmospheric). This ejector system, combined with higher pressure steam from the lower purge zone, acts to remove any stray or residual gases from the shale mixture via line 18, including combustion gases that are not removed from the combustion zone 7. The temperature in this zone is approximately 800°–950°F. (426°–510°C.).

In zone 7, the combustion zone, the descending shale encounters air, preheated in 19, introduced by line 21, and distributed by distributor 20, which results in controlled combustion of the carbonaceous residue, thus producing heat and combustion gases. Though not shown, air can be introduced into zone 7 by more than 1 pipe. The combustion of the residue is controlled by regulating the conditions in zone 7. By varying the retorting temperature in zone 4, the amount of carbonaceous residue can be varied. It is realized that too much residue indicates improper retorting, with accompanying loss of desirable reaction products. On the other hand, a certain amount of residue is necessary to furnish the heat required in other portions of the process. Thus, by varying the amount of residue formed on and in the shale mixture and the amount of air (oxygen), and its temperature, entering the combustion zone through line 21, the temperature of the combustion zone, and thus the temperature of the hot spent shale, can be controlled. Decomposition of carbonates in the shale is endothermic in nature, so the combustion zone temperature is maintained to give a desirable balance between minimal carbonate decomposition and enough heat output for the rest of the process. Uncontrolled combustion in this zone could lead to high temperatures that would require more expensive materials of construction and would result in inefficient heat utilization. Depending on the air flow, the combustion temperature, the amount of carbonaceous residue, etc., the majority of the combustion gases is composed of $CO_2$, CO and $N_2$, with a smaller amount of unreacted $O_2$. Also, depending on any sulfur or nitrogen compounds found in the carbonaceous residue, there may also be sulfur and nitrogen compounds in the vent gases, along with some dust. Typically, the combustion gases, leaving zone 7 through line 8, can be vented through line 22, utilized in the lift engager through line 23 and a thermal compressor, used in air preheater 19, or run through another combustion zone to oxidize the CO to $CO_2$, or mixed with the fresh shale to pre-heat the shale. The disposition of these waste gases through line 8 is not critical to the invention; further utilization of the gases improves the efficiency of the process.

The pressure in combustion zone 7 is approximately atmospheric, (2–5 inches of water above atmospheric) (50.8–127 kg./m²) while the temperature typically varies from about 900°–1400°F., (482°–760°C.), the maximum found in the process. In one embodiment, a heat exchanging device, such as heat exchanger coils 24, can be used in this zone to change boiler feed water 25 to steam 26, thus utilizing a portion of the available heat. The combustion zone is the primary heat source for the process. Controlled combustion of the carbonaceous residue on and in the retorted shale mixture furnishes heat to raise the temperature of the shale exiting this zone (hot spent shale) to about 900°–1400°F. (482°–760°C.). At least a portion of this hot spent shale is moved via hopper section 1, where it is typically mixed with fresh feed shale 28. The mixture then proceeds to the reaction section 4, in which the conditions of temperature and residence time are sufficient to cause thermal decomposition of the kerogen of the shale, thus liberating the desirable reaction products. As mentioned previously, the transport of the hot spent shale to the recycle hopper section is well understood by those skilled in the art.

Since the output of a retorting vessel is typically calculated in barrels of desirable reaction products per day, this means that a certain number of tons of fresh shale 29 must be retorted each day. Since a portion of the hot spent shale is recycled, this means that a certain portion of the spent shale is discarded through line 30. The overall efficiency of the process is improved if recoverable heat is extracted from this discarded spent shale, such as by a heat exchanger 31 in which boiler feed water 32 is converted to steam 33.

As an example of this process, fresh shale assaying 30 gal./ton, (129 l./metric ton) by Fischer assay, is used as a basis for calculating inputs and outputs.

For every ton (0.9 metric ton) of fresh shale, $C_3^-$ gas product is obtained in the amount of about 700 SCF (19.8m³) (dry basis) having a heating value of approximately 775 BTU/SCF (6900 kg. cal./m³). This is approximately 48 lbs./ton (24g./kg.). A liquid $C_4^+$ product is obtained in the amount of about 31.7 gal./ton (132 l./metric ton), having about 0.8 wt.% S, 2 wt.% N and 24° API. This is approximately 240 lbs./ton (120 g./kg.).

The retorted shale (from zone 4) is approximately 1712 lbs. (777 kg.), based on 1 ton (907 kg.) of fresh shale, of which approximately 62 lbs. of carbon/ton (31 g./kg.) of fresh shale are burned off under controlled combustion, leaving approximately 1650 lbs. (750 kg.) of hot spent shale discharged from zone 7 to the spent shale cooler per ton (907 kg.) of fresh shale introduced. This amount of carbon is approximate and is based on the reaction of carbon being oxidized to $CO_2$, giving the equivalent heat required to raise the temperature of one ton (907 kg.) of fresh shale from ambient to reactor temperature. A greater quantity of carbon will be burned if CO is an appreciable amount of the combustion gas.

Recycle shale, at an approximate temperature of about 1200°F. (649°C.), is withdrawn and used at about 5600 lbs. per ton (2.8 g./kg.) of fresh shale. This amount of recycle shale can vary, depending on the amount of preheating done on the fresh shale.

The apparatus used for the above-described process is typically a vertically oriented cylindrical retorting vessel, having the described zones placed in the proper order and physically separated, one from the other, as described. The physical dimensions of the vessel are naturally dependent upon the desired throughput. The L/D ratio for the retort is not critical but is typically in the range of about 8. Typical materials of construction are used, since the maximum operating temperature is about 1400°F (760°C.). A 20 ft. (6.1m.) diameter retort would have the capacity for producing 25,000 BPD (3980 m³/day) of shale oil. The relative sizes or proportions of the various zones, based on the total vessel size, are approximately 25–30% for the reaction section, 35–40% for the combustion zone, 5–10% for the recycle hopper zone and each of the first and second low pressure zones, and 10–15% for each of the purge zones. More importantly, the reaction zone is sufficient in volume to maintain a fresh shale residence time of from about 2 to about 6 minutes.

While the present invention has been described herein with reference to particular embodiments thereof, it will be appreciated by those skilled in the art that various changes and modifications can be made without departing from the scope of the invention as set forth.

I claim:

1. A process for the retorting of hydrocarbons from oil shale granules in a retorting vessel in which the oil shale is subjected to thermal decomposition of the kerogen component of the shale by the addition of heat, in the substantial absence of oxygen, and from which distillation reaction products are obtained substantially free of gaseous products of combustion, during the downward passage of shale through a plurality of physically separated zones in the vessel, the process comprising:

a. mixing fresh oil shale and hot spent shale in a hopper zone b. removing gases from the shale mixture in a first sub-atmospheric pressure zone, c. subjecting the shale mixture to an inert purge stream in a first purge zone, d. forming reaction products by thermal decomposition of kerogen in a reaction zone and removing and recovering said reaction products, incidentally forming a carbonaceous residue on the shale, e. subjecting the retorted shale mixture to an inert purge stream in a second purge zone, f. removing gases from the retorted shale mixture in a second sub-atmospheric pressure zone, and g. heating the retorted shale mixture by combustion of its carbonaceous residue in a combustion zone to form hot spent shale.

2. The process of claim 1 in which the products of combustion or of carbonate decomposition in the combustion zone are kept separate from the reaction products of the reaction zone.

3. The process of claim 1 in which a. in the hopper zone, the average temperature ranges from about 800° to about 950°F., and the pressure is essentially atmospheric, b. in the first low pressure zone, the temperature is approximately the same as in (a) and the pressure is about 2 to 10 inches of water less than atmospheric, c. in the first purge zone, the temperature is approximately the same as in (b), and the pressure is about 10 to 50 inches of water above atmospheric, d. in the reaction zone, the temperature is approximately the same as in (c) and the pressure is about 5 to 40 inches of water above atmospheric, e. in the second purge zone, the temperature is approximately the same as in (d) and the pressure is about 10 to 50 inches of water above atmospheric, f. in the second low pressure zone, the temperature is approximately the same as in (e) and the pressure is about 2 to 10 inches of water less than atmospheric, and g. in the combustion zone, the temperature is from about 900° to about 1400°F., and the pressure is about 2 to 5 inches of water above atmospheric.

* * * * *